United States Patent [19]

Hamano et al.

[11] Patent Number: 4,590,385

[45] Date of Patent: May 20, 1986

[54] AUTOMATIC STARTER

[75] Inventors: Isao Hamano; Akira Morishita; Yoshifumi Akae; Toshinori Tanaka; Kouichi Matsumoto; Takeo Gotou; Kiyoshi Yabunaka, all of Hyogo, Japan

[73] Assignee: Mitsubishi Denki Kabushiki Kaisha, Tokyo, Japan

[21] Appl. No.: 552,194

[22] Filed: Nov. 15, 1983

[30] Foreign Application Priority Data

Nov. 15, 1982 [JP] Japan ..... 57-173657[U]

[51] Int. Cl.[4] ..... F02N 11/08

[52] U.S. Cl. ..... 290/38 E; 74/513

[58] Field of Search ..... 290/38 R, 38 C, 38 E, 290/DIG. 1, DIG. 11; 74/6, 7 R, 513, 850

[56] References Cited

U.S. PATENT DOCUMENTS

| | | | |
|---|---|---|---|
| 1,948,198 | 2/1934 | Blake | 290/38 E |
| 2,399,542 | 4/1946 | Collins | 290/38 E |
| 2,609,514 | 9/1952 | Schneider et al. | 290/38 E |
| 2,799,745 | 7/1957 | Scutt | 290/38 E |
| 4,179,949 | 12/1979 | Hildebrecht | 74/513 X |
| 4,237,752 | 12/1980 | Hildebrecht | 74/513 X |

*Primary Examiner*—William M. Shoop, Jr.
*Assistant Examiner*—W. E. Duncanson, Jr.
*Attorney, Agent, or Firm*—Sughrue, Mion, Zinn, Macpeak & Seas

[57] ABSTRACT

An automatic starter for a vehicle equipped with an automatic transmission with which excessively abrupt starting of the engine of the vehicle is inhibited. The automatic starter includes an accelerator pedal having first and second accelerator pedal members. The first accelerator pedal member is attached to the second accelerator pedal member through a returning elastic member so as to be biased apart. A rod extends downwardly from the second accelerator pedal member through the first accelerator pedal member with the lower end of the rod forming the operating element of a solenoid. The two accelerator pedal members carry contacts which are closed when the second accelerator pedal member is depressed downwardly against the first accelerator pedal member. Upon the starting of the vehicle, the solenoid is energized to hold the two accelerator pedal members together.

5 Claims, 3 Drawing Figures

AUTOMATIC STARTER

BACKGROUND OF THE INVENTION

The present invention relates to an improved automatic starter for use in a vehicle equipped with an automatic transmission.

An automatic starter of the same general type as that to which the invention pertains, and which is disclosed in Japanese Patent Publication No. 56 - 48693, will be explained by way of example with reference to FIG. 1. In FIG. 1, reference numeral 1 indicates a battery mounted on a vehicle, and 2 indicates a keyswitch having an ignition terminal IG connected to a later-described ignition circuit and a starter terminal ST connected to a starter circuit 3. Reference numeral 4 indicates an ignition circuit which is connected to the ignition terminal IG. Reference numerals 5 and 6 indicate a detecting unit and an accelerator pedal, respectively. Reference numeral 7 indicates an acceleration detecting device which indicates a first acceleration switch 7*a* acting as a first acceleration detector and a second acceleration switch 7*b* acting as a second acceleration detector. Reference numerals 8, 9, 9*a*, 10 and 10*a* indicate a memory circuit, an ignition control circuit, an ignition relay, a starter control circuit and a starter relay, respectively.

Next, the operation of the starter apparatus thus far described will be explained. First, the keyswitch 2 is closed at the ignition terminal IG. Then, the memory circuit 8 stores and sends out a signal which is generated by the detecting unit 5. The stored signal is applied to the ignition control circuit 9 and the starter control circuit 10 to effect an operational standby state in which the engine can be automatically started and stopped. If, in this state, the accelerator pedal 6 is depressed by a stroke deeper than a first set value and shallower than a second set value so as to effect the starting operation, the first acceleration switch 7*a* is closed to close the ignition relay 9*a* through the ignition control circuit 9 and the starter relay 10*a* through the starter control circuit 10. As a result, the ignition circuit 4 and the starter circuit 3 are energized to start the engine. After the engine starts the end of the starting operation is sensed by the starter detecting signal for confirming the start from the detecting unit 5, and the starter relay 10*a* is opened to block the supply of power to the starter circuit 3 so that the engine can be automatically started. The second acceleration switch 7*b* is employed together with the first acceleration switch 7*a* so as to detect the rate at which the accelerator pedal 6 is depressed and is used to prevent malfunctions.

The automatic starter of the prior art thus far described has a defect in that the vehicle may be abruptly started if the accelerator pedal 6 is abruptly depressed. The present device has been conceived in view of the foregoing defect.

SUMMARY OF THE INVENTION

Overcoming the drawbacks of the prior art, the invention provides an automatic starter which prevents abrupt starting by a simple construction whereby the accelerator pedal is made extendible and contractible, by sliding movements, in two stages.

More specifically, the accelerator pedal is divided into two portions biased apart from one another by a spring. When the second portion is depressed toward the first portion, contacts are closed which energize the starter motor of the vehicle. Once the vehicle has started, a solenoid is energized which holds the two pedal portions together.

DESCRIPTION OF THE PREFERRED EMBODIMENTS

A preferred embodiments of the present invention will now be described with reference to the accompanying drawings.

Figure 2:
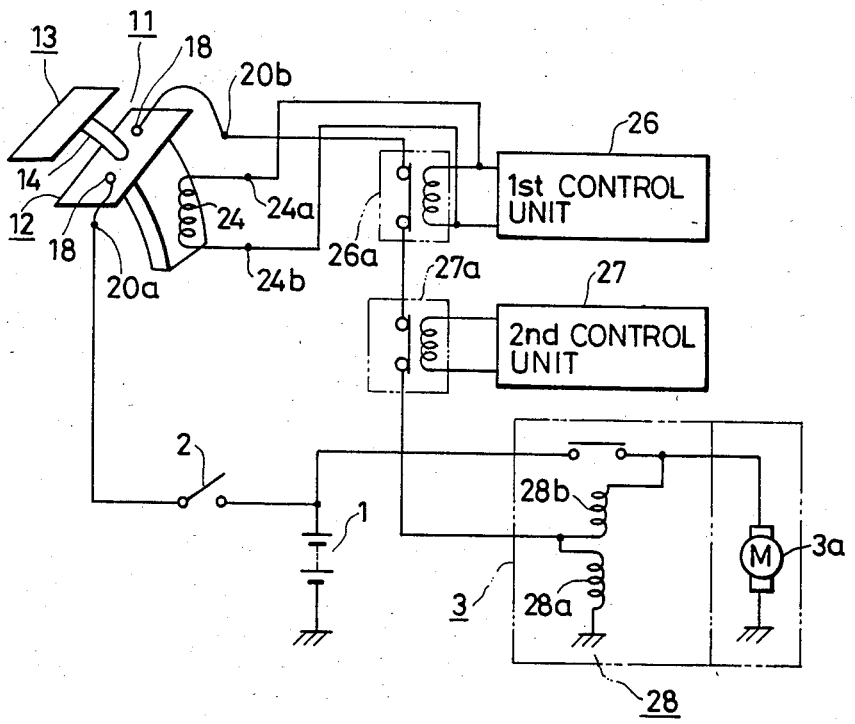
FIG. 2 is a diagram showing an automatic starter according to a preferred embodiment of the present device.
Figure 3:
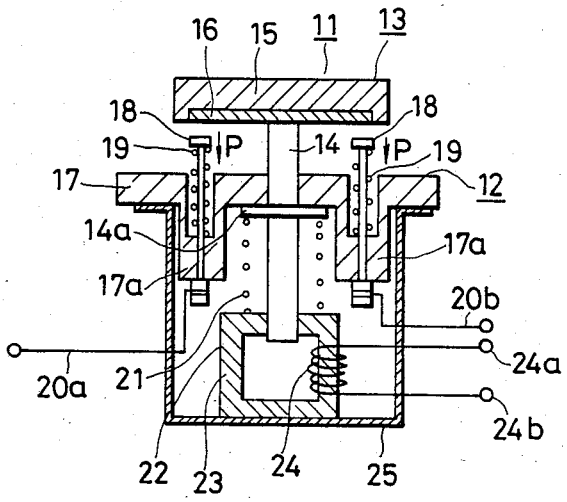
FIG. 3 is a sectional view showing a major portion of the accelerator pedal of FIG. 2.

FIG. 2 is a schematic circuit diagram showing an automatic starter according to one embodiment of the present device, and FIG. 3 is a sectional view showing specific important portions of the accelerator pedal of FIG. 2. In FIG. 2, reference numeral 11 indicates an accelerator pedal, the specific construction of which is shown by way of example in FIG. 3. Reference numeral 12 indicates a first accelerator pedal member in which a rod 14 of a second accelerator pedal member 13 is slidably mounted at a central portion thereof. An electrically insulated depression plate 15 forms a part of the second accelerator pedal member 13. A moving contact 16 is embedded in the depression plate 15 and fixed integrally to the rod 14. A depression plate 17, which forms a part of the first accelerator pedal member 12, has inward protrusions 17*a* formed integrally therewith. At the ends of the protrusions 17*a* are mounted a pair of responding contacts 18 which can slide in the direction indicated by an arrow P. Return springs 19 are interposed between the protrusions 17*a* and the leading ends of the responding contacts 18 to bias the responding contacts 18 toward the moving contact 16 of the second accelerator pedal memeber 13.

Lead wires 20*a* and 20*b* are respectively connected to the lower ends of the respective responding contacts 18. A return coil spring 21 is interposed under tension between a flange 14*a* formed at the central portion of the aforementioned rod 14 and the yoke 23 of a solenoid 22. An attracting and holding coil 24 wound on the yoke 23 has terminals 24*a* and 24*b* leading to the outside of a case 25.

In the accelerator pedal 11 thus far described, when the second accelerator pedal member 13 is depressed downwardly in the drawing by the driver, the rod 14 slides in the direction P relative to the first accelerator pedal member 12, and the moving contact 16 is brought during the sliding movement into abutment against the paired responding contacts 18 to close the contact circuit. The second accelerator pedal member 13 is then attracted and held in that state by the action of the solenoid 22.

Returning to FIG. 2, the keyswitch 2 is connected to one lead wire 20*a* of the accelerator pedal 11 while the contact of a relay 26*a* driven by the first control unit 26 is connected to the other lead wire 20*b*. That first control unit 26 constitutes a logical sum switch in which a switch, made operative in response to ignition pulses which are transmitted from the ignition circuit 4 in a manner similar to the prior art automatic starter of FIG.

Figure 1:
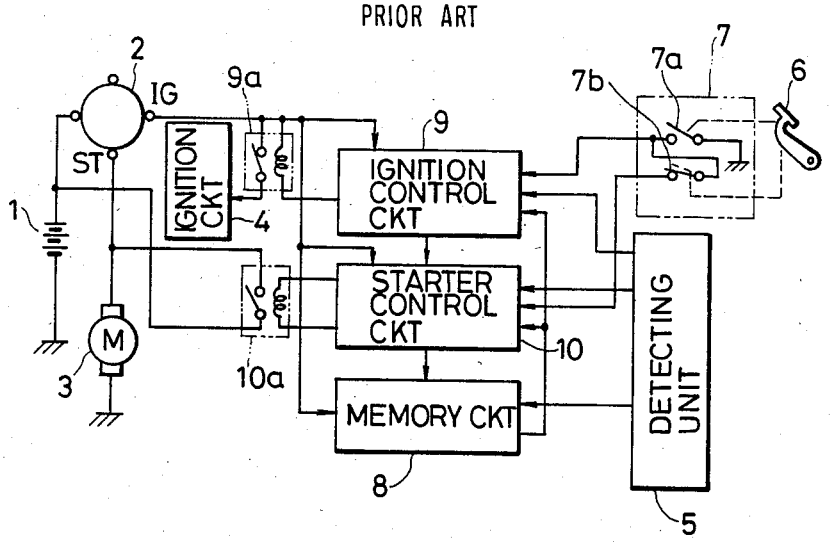
FIG. 1 PRIOR ART
FIG. 1 is a schematic block diagram showing an automatic starter constructed according to the prior art.

1, is connected in parallel with a switch made operative upon detection of the running operation of the vehicle by the action of a vehicular speed sensor. To the first control unit 26 is connected the terminals 24*a* and 24*b* of the coil 24 which constitutes the solenoid 22 of the accelerator pedal 11 and which is made operative to simultaneously energize the aforementioned coil 24 and the coil of the relay 26*a*. Reference numeral 27 indicates a second control unit which acts as an engine rotation detecting device which is composed of an alternator and a relay energized by the rotation of the engine. The terminal voltage of the alternator drives the relay 27*a*, which is connected between the input terminals of the coils 28*a* and 28*b* constituting the electromagnetic switch 28 of the starter circuit 3 and the aforementioned relay 26*a*. In this case, normally closed contacts are used as the contacts of the aforementioned respective relays 26*a* and 27*a*. The first control unit 26 may be a vehicular speed detecting switch. The remainder of the apparatus may have a contruction similar to that shown in FIG. 1 and which is indicated with the same reference numerals.

The operation of the automatic starter thus far described will now be explained. When the keyswitch 2 is closed and the accelerator pedal 11 is depressed while the car is halted, the second accelerator pedal member 13 is first depressed. Then, the movable contact 16 mounted on the second accelerator pedal member 13 comes into abutment against the paired responding contacts 18, thereby to close their contact circuit. As a result, the voltage of the power source (battery) 1 of the vehicle is applied through the keyswitch 2, the moving contact 16, and the contacts of the relays 26*a* and 27*a* to the electromagnetic switch 28 of the starter circuit 3 so that the starter 3*a* is rotated to crank (start) the engine. After the engine starts, the first control unit 26 drives the relay 26*a* to open its contact so that energization of the aforementioned electromagnetic switch 28 is released to automatically stop the starter 3*a*. Simultaneously, the coil 24 of the accelerator pedal 11 is energized by the aforementioned first control unit 26 so that the rod 14 of the second accelerator pedal member 13 is attracted and held by the solenoid 22 to operate integrally with the first accelerator pedal member 12. As a result, if the accelerator pedal 11 is further depressed in this state, the rotational speed of the engine increases so that the car is automatically started.

Thus, according to the invention, even if the accelerator pedal is abruptly depressed during the automatic starting of the engine, the movement of second accelerator pedal member 13 is damped relative to the first accelerator pedal member 12 by the deflection of the coil spring 21 interposed therebetween. As a result, rapid acceleration of the engine is prevented by the damping action of the second accelerator pedal member 13 so that the car is prevented from abruptly starting.

As has been described hereinbefore, in the automatic starter of the present invention, the accelerator pedal has a construction whereby it is extendible and contractible in two stages, and the various control units are connected in series with the starter circuit. As a result, it is possible, with a simple construction, to prevent overly abrupt starting of the car. Moreover, another excellent effect is that the starter is prevented from being engaged and energized during the normal operation of the engine.

We claim:

1. An automatic starter for a vehicle equipped with an automatic transmission, in which the improvement comprises an accelerator pedal comprising: a first accelerator pedal member; a second accelerator pedal member attached to said first accelerator pedal member through a returning elastic member in a manner so as to be movable back and forth in a depressing direction of said accelerator pedal; attracting and holding means for attracting and holding said second accelerator pedal member to retain said second accelerator pedal member integrally with said first accelerator pedal member, whereby said accelerator pedal is extendible and contractible in two stages; and means for energizing said attracting and holding means during rotation of an engine of said vehicle to attract and hold said second accelerator pedal member.

2. The automatic starter of claim 1, wherein said means for energizing said attracting and holding means comprises contact means having first and second portions associated with said first and second accelerator pedal members, respectively, said first and second portions being closed when said second accelerator pedal member is depressed toward said first accelerator pedal member, said contact means being connected in series between a battery and a starter motor of said vehicle.

3. The automatic starter of claim 1, wherein said attracting and holding means comprises a rod extending downwardly from said second accelerator pedal member through a portion of said first accelerator pedal member; and solenoid means including as an operating element a lower end of said rod.

4. The automatic starter of claim 2, wherein said contact means comprises a conductive plate mounted on a lower side of said second accelerator pedal member; and first and second protruding rods extending outwardly from said first accelerator pedal member in a position to be contacted by respective portions of said plate when said second accelerator pedal member is depressed; and spring means for biasing said protruding rods in the direction of said second accelerator pedal member.

5. The automatic starter of claim 4, wherein said means for energizing said attracting and holding means comprises an engine speed detecting switch and a vehicular speed detecting switch connected in series with one another.

* * * * *